US007557320B1

(12) United States Patent
Crooijmans et al.

(10) Patent No.: US 7,557,320 B1
(45) Date of Patent: Jul. 7, 2009

(54) SURFACE-MOUNT DOME SWITCH

(75) Inventors: Wilhelmus M. C. Crooijmans, San Jose, CA (US); Christopher D. Prest, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/183,038

(22) Filed: Jul. 30, 2008

(51) Int. Cl.
*H01H 5/30* (2006.01)

(52) U.S. Cl. ..... 200/406; 200/516

(58) Field of Classification Search ..... 200/406, 200/516

See application file for complete search history.

(56) References Cited

U.S. PATENT DOCUMENTS 4,778,952 A * 10/1988 Watkins et al. ..... 200/5 A
6,303,888 B1 * 10/2001 Okamoto et al. ..... 200/517
6,333,477 B1 * 12/2001 Koyama et al. ..... 200/513
6,995,324 B2 * 2/2006 Asada ..... 200/1 B
7,012,208 B2 * 3/2006 Wang ..... 200/341
7,057,128 B1 * 6/2006 Oyagi et al. ..... 200/406
7,235,754 B2 * 6/2007 Rochon et al. ..... 200/406
7,429,707 B2 * 9/2008 Yanai et al. ..... 200/1 B
7,449,654 B2 * 11/2008 Tsuduki ..... 200/406

* cited by examiner

*Primary Examiner*—Michael A Friedhofer
(74) *Attorney, Agent, or Firm*—Kramer Levin Naftalis & Frankel LLP

(57) ABSTRACT

This invention is directed to a surface-mounted dome switch for use in an electronic device. The switch may include a dome having a conductive inner surface operative to create an electrical path between adjacent conductive pads of a circuit board. The dome may include a tab extending away from the periphery of the dome such that the tab is parallel to the circuit board when the dome is mounted to the circuit board. The tab may be mounted a pad on the circuit board using SMT, in the same manner that any other electronic device component would be mounted. In some embodiments, a raised edge may be inserted underneath the dome to increase the travel required to actuate the dome. The increased travel may provide a more pleasing user experience.

31 Claims, 3 Drawing Sheets

SURFACE-MOUNT DOME SWITCH

BACKGROUND OF THE INVENTION

This invention is directed to dome switch for use in an electrical device. A dome switch may be used to provide electrical signals to an electronic device in response to a physical actuation provided by a user. For example, a dome switch may include a dome with a conductive inner surface operative to close a circuit when the dome is pressed and the inner surface is placed in contact with one or more pads located underneath the dome, for example pads of a circuit board.

The dome may be coupled to the circuit board using any suitable approach. For example, an adhesive sheet may be placed over the dome such that a portion of the adhesive sheet extends beyond the periphery of the dome and may be coupled to the circuit board. The amount of adhesive sheet extending beyond the periphery of the dome may be selected to allow the dome to deform (e.g., in response to a user input) while maintaining the dome mounted to the circuit board.

Domes may be manufactured using any suitable approach. For example, several domes may be stamped from sheet metal and distributed on an adhesive sheet. The manufacturer may then provide a sheet that includes several domes to a device manufacturer, who may in turn extract domes with adhesive extending beyond the periphery of the domes to couple the domes to the electronic device. The manufacturing process, however, may be costly as domes must be accurately placed on an adhesive sheet, and the adhesive sheet must be cut to extract individual domes. In fact, the cost of the adhesive sheet alone may be significantly larger than the cost of the domes placed on the sheet.

SUMMARY OF THE INVENTION

A dome switch operative to be surface-mounted without the use of an adhesive sheet is provided.

The dome switch may include a dome having a conductive inner surface and a tab extending from the periphery of the dome. The tab may be oriented to extend away from the inner surface of the dome. The dome may be operative to mounted to a circuit board including at least two pads. The circuit board may include a center pad over which the dome may be placed. The circuit board may also include a second pad operative to be coupled to the tab to retain the dome over the center pad.

The second pad may be positioned outside of the area defined by the periphery of the dome when the dome is mounted to the circuit board. The second pad may be sized using any suitable approach, including for example based on the size of the tab, or based on the coupling required to retain the dome mounted to the circuit board. The tab may be mounted to the second pad using any suitable approach, including for example soldering or surface-mount technology.

In response to the user actuating the dome, the dome may deform such that the inner surface of the dome contacts the center pad. This may create an electrically conductive path between the second pad and the center pad via the tab and inner surface of the dome. In response to detecting the electrically conductive path (e.g., a circuit is closed), the electronic device may perform a suitable operation.

In some embodiments, a raised edge may be inserted between the periphery of the dome and the circuit board. The raised edge may increase the travel required for the dome to contact the center pad, which may improve a user's experience. In some embodiments, only one edge or portion of the dome may be raised. For example, the tab may be folded over itself away from the dome to increase the height between the dome and the circuit board, for the portion of the dome adjacent to the tab, by the thickness of the tab.

BRIEF DESCRIPTION OF THE DRAWINGS

The above and other features of the present invention, its nature and various advantages will be more apparent upon consideration of the following detailed description, taken in conjunction with the accompanying drawings, and in which.

DETAILED DESCRIPTION

A dome switch operative to be directly mounted to the surface of a circuit board is provided. The dome switch may include a deformable dome having a conductive inner surface. The dome may be placed over one or more conductive pads of a circuit board such that the dome is operative to close a circuit between the one or more conductive pads and the circuit board when the dome is pressed (e.g., and inner surface of the dome comes into contact with the one or more conductive pads.

The dome may include one or more tabs extending from the periphery of the dome and operative to be coupled to the circuit board (e.g., soldered to a solder pad of the circuit board). The size and distribution of the tabs may be determined based on any suitable criteria, including for example the size of the dome and the expected force applied to the dome. For example, large domes may include several tabs individually coupled to a circuit board.

In some embodiments, additional layers of material may be placed between a dome and the circuit board to raise the dome (e.g., and increase the height between the top of the dome and the circuit board). The increased height may require a user to apply additional force to the dome to provide an input, which may provider a crisper user experience and a superior tactile fee.

Figure 1:
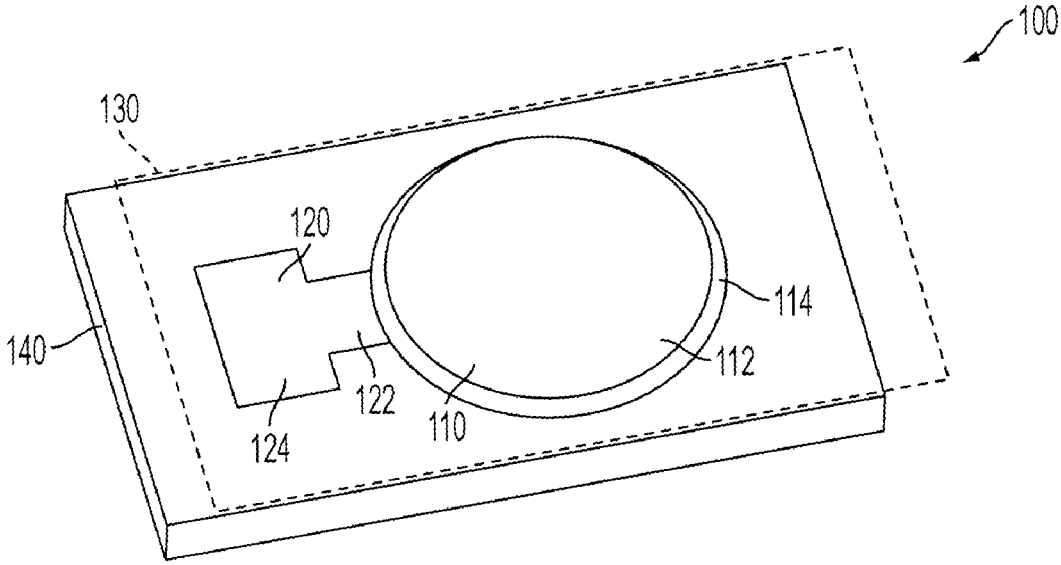
FIG. 1 is a schematic view of an illustrative dome switch mounted to a circuit board in accordance with one embodiment of the invention.

FIG. 1 is a schematic view of an illustrative dome switch mounted to a circuit board in accordance with one embodiment of the invention. Dome assembly 100 may include dome 110 and circuit board 140. Dome 110 may include raised surface 112 and wall 114. Raised surface 112 may have any suitable shape, including for example a curved surface or a planar (e.g., flat) surface. Dome 110 may have any suitable shape (e.g., defining the periphery of raised surface 112). For example, dome 110 may have a circular, polygonal, or any other suitable periphery. In some embodiments, the periphery of dome 110 may be determined or selected based on restrictions or limitations of the electronic device or circuit board for which the dome is used. The periphery of dome 110 and the shape of raised surface 112 (e.g., the topology of raised surface 112) may be selected to allow a user to deform dome 110 with a selected force while remaining within a predetermined footprint.

Dome 110 may be constructed from a deformable material such that, upon pressing dome 110, raised surface 112 may be placed in contact with a conductive pad of circuit board 140. Raised surface 112 may be operative to deform in any suitable manner, including for example to buckle or invert. The inner surface of dome 110 may include a conductive portion such that an electrically conductive path may pass through dome 110 to the conductive pad, thus closing a circuit that the electronic device may detect. Alternatively, the entirety of dome 110 may be conductive (e.g., dome 110 is constructed from a conductive material, such as a metal).

Figure 2:
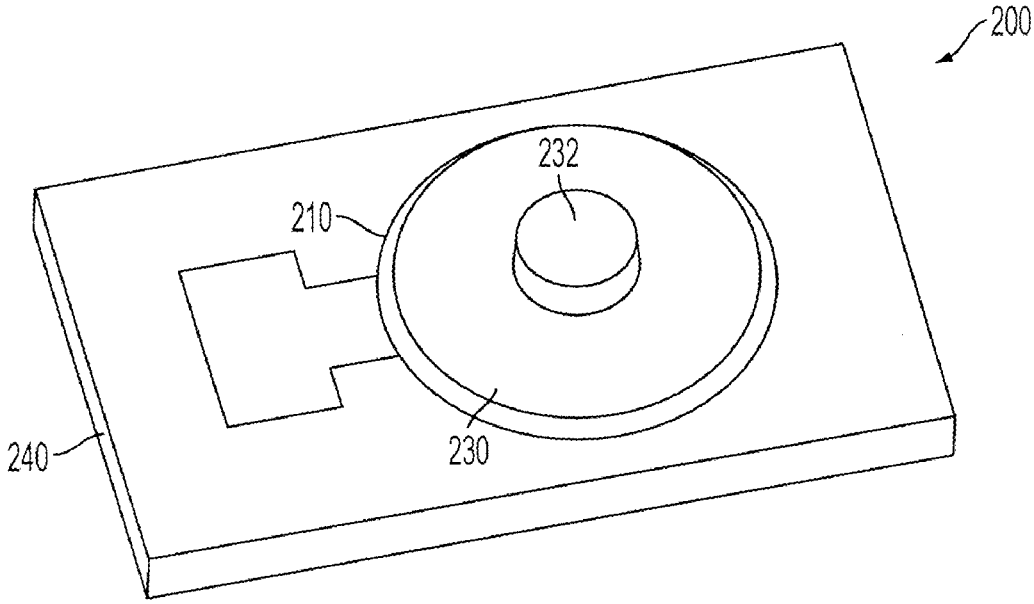
FIG. 2 is a schematic view of the illustrative dome switch of FIG. 1 to which an additional component is placed in accordance with one embodiment of the invention.

In some embodiments, an additional component may be placed on raised surface 112. FIG. 2 is a schematic view of the illustrative dome switch of FIG. 1 to which an additional component is placed in accordance with one embodiment of the invention. Dome assembly 200 may include dome 210 and circuit board 240. Dome 210 may include dome 230 placed over dome 210. Dome 230 may be coupled to dome 210 using any suitable approach, including for example using an adhesive, tape, mechanical fastener, or any other suitable coupling mechanism. Dome 230 may be constructed in any suitable shape, including for example the same shape as dome 210, or a larger or smaller shape. Dome 230 may have any suitable mechanical properties such that, for example, the force required to actuate dome 230 (e.g., before dome 210 can be actuated) is a particular selected or predefined amount. Dome 210 may include any other suitable component coupled to the top surface of dome assembly 200. For example, dome assembly 200 may include nub 232 operative to provide an additional element for tactile feedback. Nub 232 may include any suitable shape, including for example a feature for receiving or engaging an electronic device component (e.g., a button). In some embodiments, nub 232 may be a solid (e.g., so that a force applied to nub 232 is directly applied to one or both of domes 210 and 230). Nub 232 may be coupled to dome 210, dome 230, or any other element of dome assembly 200.

Dome 110 (or any of the domes of FIG. 2) may be manufactured using any suitable approach. In some embodiments, dome 110 may be stamped or punched from a sheet of material (e.g., sheet metal). Alternatively, dome 110 may be manufactured using molding, forging, machining, welding, forming, cutting, or any other manufacturing process or combination of manufacturing processes.

Dome 110 may be coupled to circuit board 140 using any suitable approach. In some embodiments, adhesive sheet 130 may be placed over dome 110 and circuit board 140 such that portions of adhesive sheet 130 adheres to both dome 110 and circuit board 140. To ensure that dome 110 remains in contact with circuit board 130, adhesive sheet 130 may extend past some or all sides of dome 110. While adhesive sheet 130 may retain dome 110 mounted to circuit board 140, it may require the area adjacent to dome 110 on circuit board 140 to be clear of components to provide an adequate surface for adhesive sheet 130. This may in turn cause space to be lost on circuit board 140 near dome 110, and may also increase manufacturing costs, as different machines or processes must be used to solder or mount electronic components to circuit board 140 and place and attach adhesive sheet 130 and dome 110 to circuit board 140.

As an alternative method for coupling dome 110 to circuit board 140, dome 110 may include one or more tabs 120 extending from dome 110. For example, tab 120 may be coupled to the bottom end of wall 114 (e.g., the end of wall 114 that is placed in contact with circuit board 140) and extend away from the area underneath raised surface 120. Tab 120 may be constructed from any suitable material, including for example the same material as dome 110. In some embodiments, tab 120 may be constructed as part of the manufacturing process of dome 110 (e.g., press or punch out tab 120 and dome 110 simultaneously).

Tab 120 may have any suitable shape or size. For example, tab 120 may be sized based on the dimensions of dome 110. The area of tab 120 may be selected to ensure that dome 110 may remain substantially fixed (e.g., not lifting from circuit board 140) to circuit board 140. In some embodiments, the coupling between tab 120 and dome 110 (e.g., along wall 114) may be biased to press dome 110 into circuit board 140 when tab 120 is coupled to circuit board 140. The total area of tab 120 may be substantially less than the area around dome 110 required by an adhesive sheet (e.g., adhesive sheet 130) to secure dome 110.

Tab 120 may have any suitable shape. In some embodiments, tab 120 may include connection portion 122 operative to connect wall 114 and mounting portion 124. Connecting portion 122 may less wide, or enclose a smaller area than mounting portion 124 to allow dome 110 to deform easily. For example, if connection portion 122 were to exceed a particular width, or were coupled to more than a particular amount of wall 114 (e.g., based on the shape of wall 114), the mechanical stresses between wall 114 and connection portion 122 may prevent a user from easily actuating dome 110.

Figure 3:
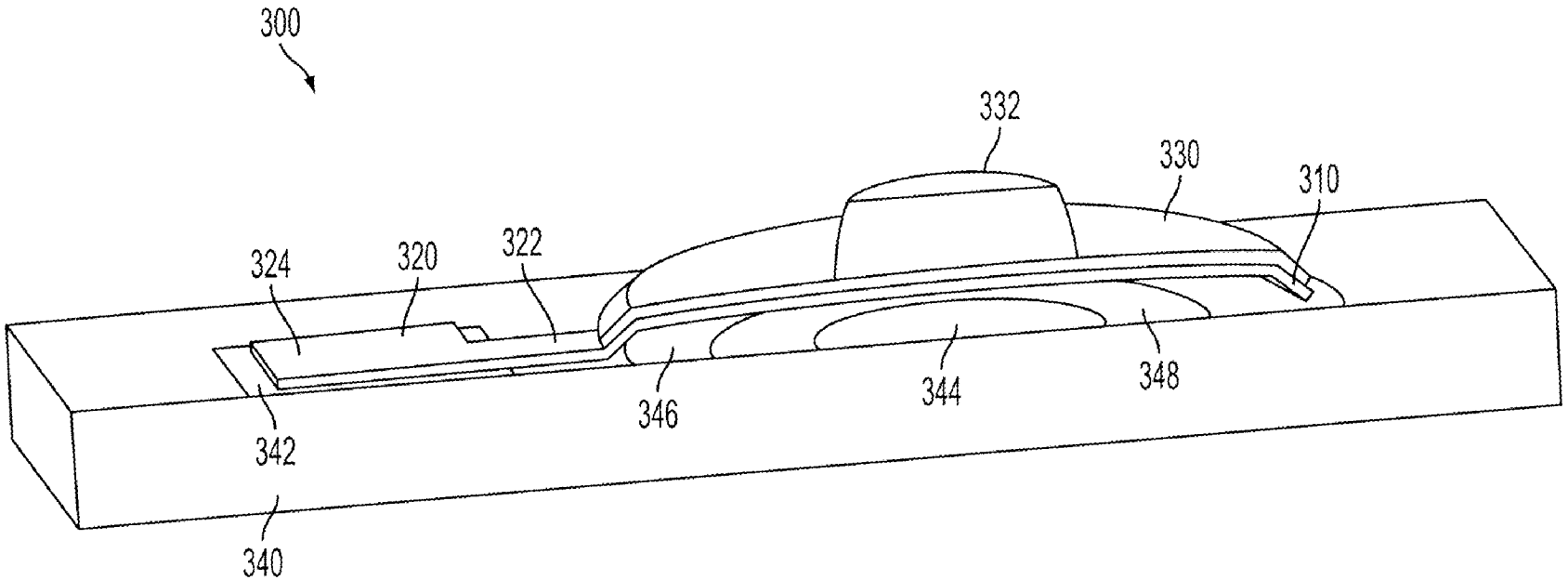
FIG. 3 is a cross-sectional view of an illustrative dome switch mounted to a circuit board in accordance with one embodiment of the invention.

Mounting portion 124 may have any suitable shape or area for mounting dome 110 to circuit board 140. In some embodiments, mounting portion 124 may be wider than connecting portion 122 to ensure that dome 110 is properly mounted to circuit board 140. The shape or dimensions of mounting portion 124 may be selected based on any suitable criteria, including for example available space on circuit board 140, the shape or area required to secure dome 110, or any other suitable criteria. For example, mounting portion 124 may be a 1×1.2 mm portion, or a 0.8×1.2 mm portion. Alternatively, mounting portion 124 may be operative to be mounted on a 1×1.2 mm pad, or a 0.8×1.2 mm pad of the circuit board. Mounting portion 124 may be operative to be coupled to circuit board 140. For example, mounting portion 124 may be operative to be attached to a pad of the circuit board. FIG. 3 is a cross-sectional view of an illustrative dome switch mounted to a circuit board in accordance with one embodiment of the invention. Dome assembly 300 may include circuit board 340 on which dome 310 is mounted. Dome 330 and nub 332 may be coupled to dome 310 to change or refine the tactile response to inputs on dome assembly 300. Dome 310 may include tab 320 extending from a portion of the periphery of the dome. Tab 320 may include connection portion 322 and mounting portion 320. The various components of dome assembly 300 may include some or all of the features of corresponding components of dome assemblies 100 (FIG. 1) and 200 (FIG. 2).

Mounting portion 324 may be coupled to any suitable portion of circuit board 340, and using any suitable approach. In some embodiments, dome 310 be coupled to board 340 using an adhesive, tape, soldering, welding (e.g., spot or laser welding), heat staking, or any other suitable process. In some embodiments, circuit board 340 may include one or more portions operative to receive tab 320, such as for example pad 342. Pad 342 may include, for example, a solder pad to which mounting portion 342 may be soldered. To prevent solder from seeping into the space underneath dome 310 and into non-conductive region 348, connection portion 322 may not be coupled to circuit board 340. This may also allow the sides of dome 310 to raise slightly when dome 310 is actuated, further enhancing the user's experience.

In some embodiments, pad 342 (and dome 310) may be mounted to circuit board 340 using surface-mount technology (SMT). For example, the same SMT machines or processes used to mount other electronic device components (e.g., resistors, capacitors, processors, memory) to circuit board 340 may also be used to mount dome 310. This may significantly reduce the manufacturing time of an electronic device, as the same process can be used to mount domes and other electronic device components (e.g., the process of mounting a dome using an adhesive may be eliminated). In addition, an SMT process may be fully automated and use optical components to ensure accuracy. In contrast, the use of an adhesive sheet may not be as easily animated or as accurate, which may further increase manufacturing costs.

Circuit board 340 may include one or more conductive pads (e.g., copper pads) placed underneath dome 310 to ensure that dome assembly 300 provides an electrical signal when dome 310 is actuated. For example, circuit board 340 may include center pad 344 and outer pad 346. Center pad 344 may be separated from outer pad 346 by non-conductive region 348. The walls of dome 310 may be positioned over outer pad 346 such that an electrically conductive path exists between outer pad 346 and dome 310. In some embodiments, dome 310 may cover center pad 344 in its entirety, and cover only a portion of outer pad 346 (e.g., a portion of outer pad 346 extends beyond the periphery of dome 310).

To provide an input to the electronic device, a user may press dome 310 such that the inner surface of dome 310 is placed in contact with center pad 344. When dome 310 contacts center pad 344, an electrically conductive path passing from outer pad 346 to center pad 344 via the inner surface of dome 311 may be provided. The electronic device may detect that an electrical circuit between center pad 344 and outer pad 346 has been closed and perform an appropriate electronic device operation.

In some embodiments, switch assembly 300 may not include outer pad 346. Instead, if tab 320 is electrically coupled to pad 342, and if tab 320 is electrically coupled to dome 310 (e.g., if tab 320 is manufactured from the same material as dome 310 or as a single component with dome 310), the user may create an electrically conductive path between pad 342 and center pad 344 in response to pressing dome 310. The electronic device may detect that an electrical circuit between pad 342 and center pad 344 has been closed and perform an appropriate electronic device operation.

Figure 4:
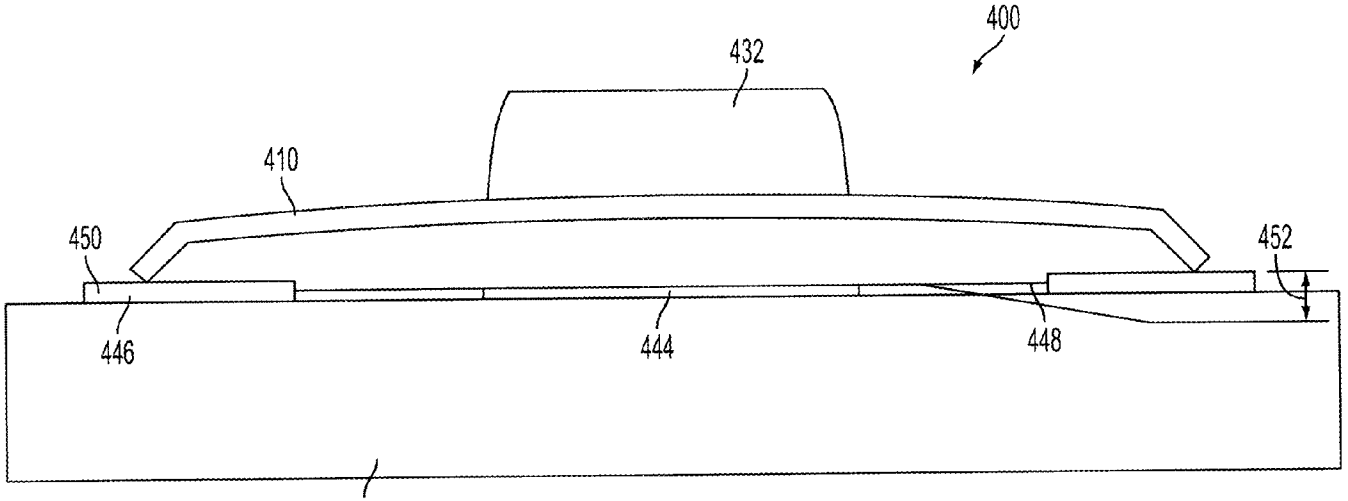
FIG. 4 is a cross-sectional view of a dome assembly having a raised dome in accordance with one embodiment of the invention.

In some embodiments, a dome may be raised to provide greater travel for the dome prior to closing the electronic device circuit. FIG. 4 is a cross-sectional view of a dome assembly having a raised dome in accordance with one embodiment of the invention. Dome assembly 400 may include dome 410 coupled to circuit board 440. Dome 410 may include nub 432, for example to allow a button or other electronic device component to engage dome 410. Dome 410 and nub 432 may be coupled to circuit board 440 using any suitable approach, including for example with an adhesive sheet, a surface-mounted tab (e.g., as described above in connection with FIGS. 1-3), or any other suitable approach.

Circuit board 440 may include conductive center pad 444 electrically connected to an electronic device component such that the electronic device may detect when dome 410 is placed in contact with center pad 444 (e.g., and closes an electrical circuit). Circuit board 440 may include conductive outer pad 446 electrically connected to an electronic device component. Outer pad 446 may be electrically coupled to dome 410 (e.g., dome 410 is overlaid on outer pad 446) to form a first electrical path that may be closed by dome 410 when dome 410 is placed in contact with center pad 444. Center pad 444 and outer pad 446 may be electrically isolated by non-conductive portion 448.

To increase the travel required for dome 410 to actuate the switch, dome assembly 400 may include raised edge 450 adjacent to the wall of dome 410. Raised edge 450 may have any suitable height, including for example a height in the range of 0.005 mm to 0.04 mm. For example, raised edge may have a height of 0.02 mm.

Raised edge 450 may be formed using any suitable approach. In some embodiments, raised edge may be incorporated in outer pad 446. For example, a lithographic process may be used to add additional material (e.g., copper) to outer pad 446. As another example, a ring of material matching the shape of the periphery of dome 410 may be coupled to circuit board 440 underneath the walls of dome 410. The material maybe coupled to circuit board 440 using any suitable approach, including for example welding, soldering, an adhesive, tape, a mechanical fastener, or any other suitable approach. In some embodiments, the ring and the coupling mechanism may retain electrical conductivity to allow an electrical path to pass from outer pad 446 through the ring and into dome 410.

If dome 410 is coupled to circuit board 440 using a conductive tab mounted to a pad of the circuit board (e.g., as shown in FIGS. 1-3), outer pad 446 may not be necessary (e.g., as the pad used to couple the conductive tab may serve as the second connection for the switch electrical circuit). Raised edge 450 may then be constructed from any suitable material, and coupled to circuit board 440 using any suitable approach (e.g., including non-conductive materials and approaches).

Figure 5:
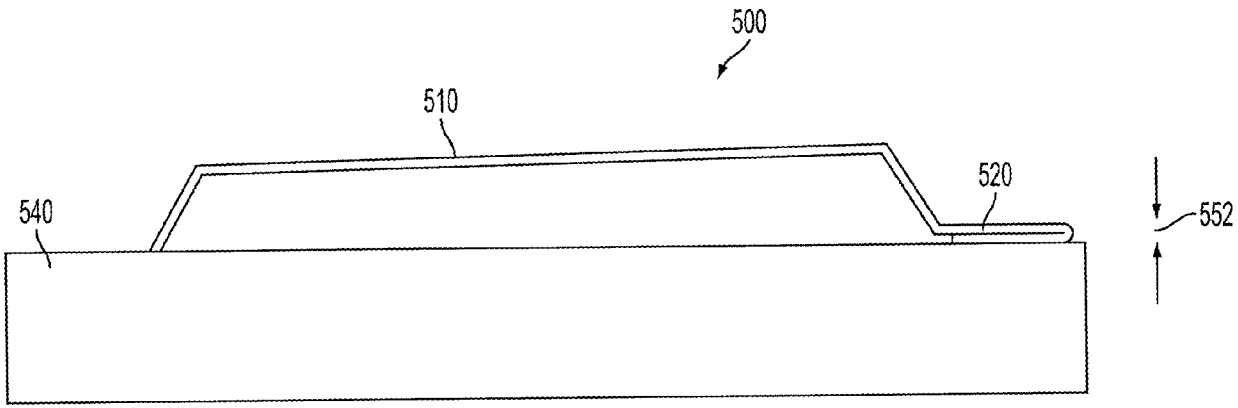
FIG. 5 is a cross-sectional view of a dome assembly having a raised dome on one side of the dome in accordance with one embodiment of the invention.

In some embodiments, only one edge of the dome may be raised (e.g., by twice the amount of each side, for example by 0.04 mm instead of each side by 0.02 mm). FIG. 5 is a cross-sectional view of a dome assembly having a raised dome on one side of the dome in accordance with one embodiment of the invention. Dome assembly 500 may include dome 510 coupled to circuit board 540 using tab 520. To increase the height of one side of dome 510, tab 520 may be folded over itself and plastically deformed to create height difference 552 between the side of dome 510 that includes tab 520 and the opposite side of dome 510. The height difference may change the force required to actuate the switch and improve the user's experience.

The above described embodiments of the invention are presented for purposes of illustration and not of limitation, and the present invention is limited only by the claims which follow.

What is claimed is:

1. A switch assembly, comprising:

a circuit board comprising at least two conductive pads;

a dome operative to be mounted on the circuit board, wherein:

the dome is placed over a first of the at least two conductive pads; and the dome comprises a tab extending from the periphery of the dome and operative to be coupled to the second of the at least two conductive pads; and a raised edge placed between the periphery of the dome and the circuit board.

2. The switch assembly of claim 1, wherein the tab extends away from the area enclosed by the dome.

3. The switch assembly of claim 1, wherein the tab is constructed from the same material as the dome.

4. The switch assembly of claim 1, wherein the tab comprises a mounting portion operative to be coupled to the second of the at least two conductive pads and a connection portion operative to connect the mounting portion to the dome.

5. The switch assembly of claim 1, wherein the periphery of the dome rests on a non-conductive portion of the circuit board.

6. The switch assembly of claim 1, wherein the height of the raised edge is in the range of 0.005 mm to 0.04 mm.

7. The switch assembly of claim 6, wherein the height of the raised edge is 0.02 mm.

8. A switch assembly, comprising:

a circuit board comprising at least two conductive pads; and a dome operative to be mounted on the circuit board, wherein:

the dome is placed over a first of the at least two conductive pads; and the dome comprises a tab extending from the periphery of the dome and operative to be coupled to the second of the at least two conductive pads, wherein the tab comprises a mounting portion operative to be soldered to the second of the at least two conductive pads and a connection portion operative to connect the mounting portion to the dome.

9. The switch assembly of claim 8, wherein the tab extends away from the area enclosed by the dome.

10. The switch assembly of claim 8, wherein the tab is constructed from the same material as the dome.

11. A switch assembly, comprising:

a circuit board comprising at least two conductive pads; and a dome operative to be mounted on the circuit board, wherein:

the dome is placed over a first of the at least two conductive pads; and the dome comprises a tab extending from the periphery of the dome and operative to be coupled to the second of the at least two conductive pads, wherein the tab comprises a mounting portion is operative to be coupled to the second of the at least two conductive pads using surface-mount technology and a connection portion operative to connect the mounting portion to the dome.

12. The switch assembly of claim 8, wherein the tab comprises a mounting portion operative to be coupled to the second of the at least two conductive pads and a connection portion operative to connect the mounting portion to the dome.

13. The switch assembly of claim 11, wherein the tab extends away from the area enclosed by the dome.

14. The switch assembly of claim 11, wherein the tab is constructed from the same material as the dome.

15. The switch assembly of claim 11, wherein the tab comprises a mounting portion operative to be coupled to the second of the at least two conductive pads and a connection portion operative to connect the mounting portion to the dome.

16. A switch assembly, comprising:

a circuit board comprising at least two conductive pads;

a dome operative to be mounted on the circuit board, wherein:

the dome is placed over a first of the at least two conductive pads; and the dome comprises a tab extending from the periphery of the dome and operative to be coupled to the second of the at least two conductive pads; and the circuit board comprises a third conductive pad located underneath the periphery of the dome.

17. The switch assembly of claim 16, wherein the tab extends away from the area enclosed by the dome.

18. The switch assembly of claim 16, wherein the tab is constructed from the same material as the dome.

19. The switch assembly of claim 16, wherein the tab comprises a mounting portion operative to be coupled to the second of the at least two conductive pads and a connection portion operative to connect the mounting portion to the dome.

20. A method for mounting a dome switch to a circuit board, comprising:

providing a circuit board with a center pad operative to be covered by a dome and a mounting pad located outside the periphery of the dome;

placing a dome having a tab extending from the periphery of the dome over the center pad;

aligning the tab with the mounting pad; and coupling the tab to the mounting pad by soldering the tab to the mounting pad.

21. The method of claim 20, wherein the dome is operative to deform and contact the center pad in response to a user input.

22. A method for mounting a dome switch to a circuit board, comprising:

providing a circuit board with a center pad operative to be covered by a dome and a mounting pad located outside the periphery of the dome;

placing a dome having a tab extending from the periphery of the dome over the center pad;

aligning the tab with the mounting pad; and coupling the tab to the mounting pad using a surface-mount technology process.

23. The method of claim 22, wherein the dome is operative to deform and contact the center pad in response to a user input.

24. The method of claim 22, further comprising coupling the raised edge to the circuit board.

25. A method for mounting a dome switch to a circuit board, comprising:

providing a circuit board with a center pad operative to be covered by a dome and a mounting pad located outside the periphery of the dome;

placing a dome having a tab extending from the periphery of the dome over the center pad;

aligning the tab with the mounting pad;

coupling the tab to the mounting pad; and placing a raised edge under the periphery of the dome.

26. The method of claim 25, further comprising coupling the raised edge to the circuit board.

27. A method for mounting a dome switch to a circuit board, comprising:

providing a circuit board with a center pad operative to be covered by a dome and a mounting pad located outside the periphery of the dome;

placing a dome having a tab extending from the periphery of the dome over the center pad;

aligning the tab with the mounting pad;

plastically deforming the tab to fold over itself; and coupling the plastically deformed tab to the mounting pad.

28. The method of claim 27, wherein deforming further comprises folding the tab over itself away from the dome such that the dome is raised by an amount equal to the thickness of the tab.

29. A dome switch for use with an electronic device, comprising:

a dome having a conductive inner surface; and a tab extending from the periphery of the dome and away from the inner surface of the dome, wherein the tab is operative to be mounted to a circuit board, wherein the tab is mounted to the circuit board using surface mount technology.

30. The dome switch of claim 29, wherein the dome and tab are stamped from a single sheet of material.

31. The dome switch of claim 29, wherein the tab is biased to retain the dome against the circuit board when the tab is mounted to the circuit board.

* * * * *